US008197763B2

(12) United States Patent
Yen et al.

(10) Patent No.: US 8,197,763 B2
(45) Date of Patent: Jun. 12, 2012

(54) ULTRASOUND-ASSISTED OXIDATIVE DESULFURIZATION OF DIESEL FUEL USING QUATERNARY AMMONIUM FLUORIDE AND PORTABLE UNIT FOR ULTRASOUND-ASSISTED OXIDATIVE DESULFURIZATION

(75) Inventors: Teh-Fu Yen, Altadena, CA (US); Meng-Wei Wan, San Gabriel, CA (US)

(73) Assignee: University of Southern California, Los Angeles, CA (US)

( * ) Notice: Subject to any disclaimer, the term of this patent is extended or adjusted under 35 U.S.C. 154(b) by 573 days.

(21) Appl. No.: 11/854,927

(22) Filed: Sep. 13, 2007

(65) Prior Publication Data

US 2008/0173571 A1 Jul. 24, 2008

Related U.S. Application Data

(60) Provisional application No. 60/825,521, filed on Sep. 13, 2006.

(51) Int. Cl.
*B06B 1/06* (2006.01)
*B06B 1/00* (2006.01)

(52) U.S. Cl. ..... 422/128; 422/127

(58) Field of Classification Search ..... 422/127, 422/128, 129

See application file for complete search history.

(56) References Cited

U.S. PATENT DOCUMENTS 4,973,876 A * 11/1990 Roberts ..... 310/316.01
5,384,508 A * 1/1995 Vaxelaire ..... 310/334
6,402,939 B1 6/2002 Yen
6,500,219 B1 * 12/2002 Gunnerman ..... 208/208 R
6,835,303 B2 * 12/2004 Mahajan ..... 208/208 R
7,160,516 B2 * 1/2007 Simon et al. ..... 422/128

OTHER PUBLICATIONS

Cal Nova Tech, A portable, modular process for sulfur removal and disposal in naval fuel cell system, Aug. 6, 2003, STTR Phase I—Progress Report No. 1.

Etemadi, Omid, Yen Teh Fu, Aspect of selective absorption in ultrasound-assisted oxidative desulfurization process of diesel fuel, American Chemical Society, May 3, 2007, 51(2), 820, ACS Publications, Washington D.C.

US Army Research Laboratory, Workshop on logistics fuel desulfurization technology for power and energy applications, Sep. 14, 2005.

Wan Meng-Wei, Yen Teh Fu, Enhance efficiency of tetraoctylammonium fluoride applied to ultrasound-assisted oxidative desulfurization (UAOD) process, Science Direct, Dec. 15, 2006, Elsevier, Cambridge, MA.

Yen Teh Fu, Investigation toward an integrated ultrasound assisted oxidative desulfurization (UAOD) process for fuels, Dec. 12, 2005, University of Southern California, Dept. of Civil and Environmental Engineering.

* cited by examiner

*Primary Examiner* — Randy Boyer
(74) *Attorney, Agent, or Firm* — McDermott Will & Emery LLP

(57) ABSTRACT

The desulfurization of fossil fuels is effected by the combination of fossil fuels with an aqueous mixture of hydroperoxide and quaternary ammonium fluoride phase transfer catalyst, the mixture then subjected to ultrasound to oxidize sulfur compounds present in the fuels. The polar oxidized species are removed via extraction. Another aspect is a portable, continuous ultrasound assisted desulfurization device having a sonoreactor for subjecting mixtures of fossil fuels to sonication to effect removal of sulfur containing compounds.

19 Claims, 6 Drawing Sheets

ULTRASOUND-ASSISTED OXIDATIVE DESULFURIZATION OF DIESEL FUEL USING QUATERNARY AMMONIUM FLUORIDE AND PORTABLE UNIT FOR ULTRASOUND-ASSISTED OXIDATIVE DESULFURIZATION

CROSS-REFERENCE TO RELATED APPLICATION

This application is based upon and claims priority to U.S. Provisional Patent Application Ser. No. 60/825,521, entitled "Enhanced Efficiency of Alkyl Substituted Quaternary Ammonium Salts with Small Arion as Part of Catalyst and a Portable Continuous Desulfurization Unit for Diesel," filed Sep. 13, 2006, the entire content of which is incorporated herein by reference.

STATEMENT REGARDING FEDERALLY SPONSORED RESEARCH

This invention was made with government support under Grant No. W911QX-04-C-001, awarded by the United States Department of the Navy. The government has certain rights in the invention.

BACKGROUND

1. Field of the Disclosure

This disclosure resides in the field of the desulfurization of petroleum and petroleum-based fuels.

2. Description of the Related Art

Diesel fuel is one of the three most important fuels, including gasoline, diesel, and jet fuels, which are widely used in transportation. Because diesel engines are inherently more thermally efficient than gasoline engines, it is expected that diesel demand and utilization will increase more in the next few decades in the 21st century. Moreover, diesel fuels are complex mixtures of alkanes, cycloalkanes, and aromatic hydrocarbons with carbon numbers in the range of C9-C28 and with a boiling-range of 150-390° C. Their relative distribution depends on the feedstock, refining process, and blending schemes based on commercial demand. Due to the higher boiling range, two more commonly found sulfur compounds in diesel are alkylbenzothiophenes (BTs) and alkyldibenzothiophenes (DBTs).

Sulfur content in diesel fuel is an environmental concern. Upon combustion, sulfur leads directly to emission of SO2 and sulfate particulate matter (PM), which endangers public health and welfare. Moreover, sulfur in petroleum often poisons catalytic converters, corrodes parts of internal combustion engines, and leads to air pollution. Because the sulfur compounds are poisonous to the shift catalyst in the hydrocarbon conversion process and the electrode catalyst in fuel cell process, the sulfur content of petroleum fuels has to be decreased to less than 0.1 ppm. Therefore, U.S. EPA has issued regulations that require the reduction of sulfur content of gasoline from 300 ppm to 30 ppm, and that of diesel fuel from 500 ppm to 15 ppm. Even more aggressive plans are being discussed or implemented for the future.

The hydrodesulfurization (HDS) or distillate hydrotreating is one of the largest scale chemical processes to remove sulfur from diesel and has been carried out in today's industry. Traditional HDS is a hydro-treatment process that requires hydrogen and a catalyst to break up the sulfur-containing compounds in diesel in order to form hydrogen sulfide.

However, unreacted hydrogen sulfide from the process is harmful, even in very small amounts. Hydrogen sulfide has an extremely high acute toxicity, which has caused many deaths in the workplace and in areas of natural accumulation, and is hazardous to workers. These hazards present health risks in many types of industries, such as the gas, oil, chemical, geothermal energy, mining, drilling, and smelting industries. One of the difficulties with the new regulations is that when hydrodesulfurization is performed under the more stringent conditions needed to achieve the lower sulfur levels, there is an increased risk of hydrogen leaking through walls of the reactor.

Furthermore, recent studies on hydrodesulfurization (HDS) indicate that organic sulfur compounds (OSCs) remaining in diesel fuel at sulfur level lower than 0.1 wt % are alkyl-DBT with alkyl substations at 4- and/or 6-position. Dibenzothiophene (DBT), 4-methyl-dibenzothiophene, and 4,6-dimethyldibenzothiophene are typical refractory sulfur compounds in diesel and other gas oils. These compounds are lower in HDS reactivity and are classified as the most refractory compounds in conventional HDS. Therefore, to reduce those refractory OSCs based on conventional approaches of HDS of diesel fuel, if the sulfur level is reduced from current 0.050 wt % to 0.0015 wt %, the volume of catalyst bed will have to be increased 3.2 times as that for current HDS catalyst bed. If the sulfur is reduced to 0.0001 wt % level, the volume of catalyst bed will have to be increased by about 7 times. It might be difficult to meet the demand by making small improvements in existing HDS technology.

One method for desulfurization of diesel fuels that has shown promise is oxidative desulfurization. Sulfur compounds are known to be slightly more polar than hydrocarbons. However, oxidized sulfur compounds such as sulfones or sulfoxides are substantially more polar than sulfides. More importantly, the oxidation of sulfides to sulfoxides or sulfones is usually much easier and faster than the oxidation of most hydrocarbons. As such, the conversion of slightly polar sulfides to more polar sulfones or sulfoxides allows for the sulfur compounds to be more easily extracted from the fossil fuels into an aqueous phase. The greatest advantages of the oxidative desulfurization (ODS) process are low reaction temperature and pressure and the fact that expensive hydrogen is not used in the process. Another advantage of ODS is that the refractory sulfur compounds in HDS are easily converted by oxidation. The applicability of an oxidative desulfurization scheme depends on the kinetics and selectivity of the oxidation of organic sulfide. Polyoxometalates have long been studied for oxidation reactions, particularly, the polyoxometalate/hydrogen peroxide system for organic substrate oxidations. It has been well documented in previous studies that the tungsten and molybdenum polyoxometalates with a Keggin structure converted to polyoxoperoxo species in the presence of hydrogen peroxide. Even sulfur compounds with low nuleophilicity, such as dibenzothiophene, can be oxidized under mild condition to sulfoxides or sulfones in high yields.

U.S. Pat. No. 6,402,939 describes a technique in which organic sulfur compounds are removed from a fossil (or petroleum-derived) fuel by a process that combines oxidative desulfurization with the use of ultrasound. The oxidative desulfurization is achieved by combining the fossil fuel with a hydroperoxide oxidizing agent in the presence of an aqueous fluid, and the ultrasound is applied to the resulting mixture to increase the reactivity of the species in the mixture. Ultrasound-assisted oxidative desulfurization (UAOD) process operating at ambient temperature and atmospheric pressure permits the selective removal of sulfur compounds from hydrocarbons by a combination process of selective oxidation and solvent extraction or solid adsorption with high yields. However, it was found that bromo by-products were formed by using quaternary ammonium bromides as phase transfer agents (PTA). This is caused by the bromide used as the anion of the quaternary ammonium salt.

Furthermore, ultrasound applied to oxidative desulfurization has accomplished high sulfur removal with a probe type reactor in a batch scale. However, in a batch process, all the reaction components are combined and held under controlled conditions until the desired process endpoint has been reached. Reactions are typically slow, taking hours, and the product is isolated at the end of the process cycle.

SUMMARY

In order to overcome the above mentioned problems, one aspect of this disclosure is directed to a method of ultrasound assisted oxidative desulfurization of fossil fuels in which the fossil fuel is combined with an aqueous hydroperoxide medium containing a fluorinated quaternary ammonium salt having at least one carbon chain of 8 or more carbon atoms as a phase transfer catalyst to achieve superior conversion of sulfides to sulfoxides with higher yield and without the unwanted formation of brominated side products.

In another aspect of this disclosure, a portable, continuous flow system for the oxidative desulfurization of fossil fuels is disclosed. The system utilizes ultrasound based on the concept of module design with a portable, continuous flow unit, which consists of a sonoreactor, a radio transmitter, a function generator, a pretreatment tank and a pipeline system, which may be operated at ambient temperature and pressure for short periods of time. In addition, to achieve higher processing of fuel and/or increased oxidation, multiple sonoreactors can be scaled up to connect in series or in parallel, respectively.

DETAILED DESCRIPTION OF ILLUSTRATIVE EMBODIMENTS

Figure 1:
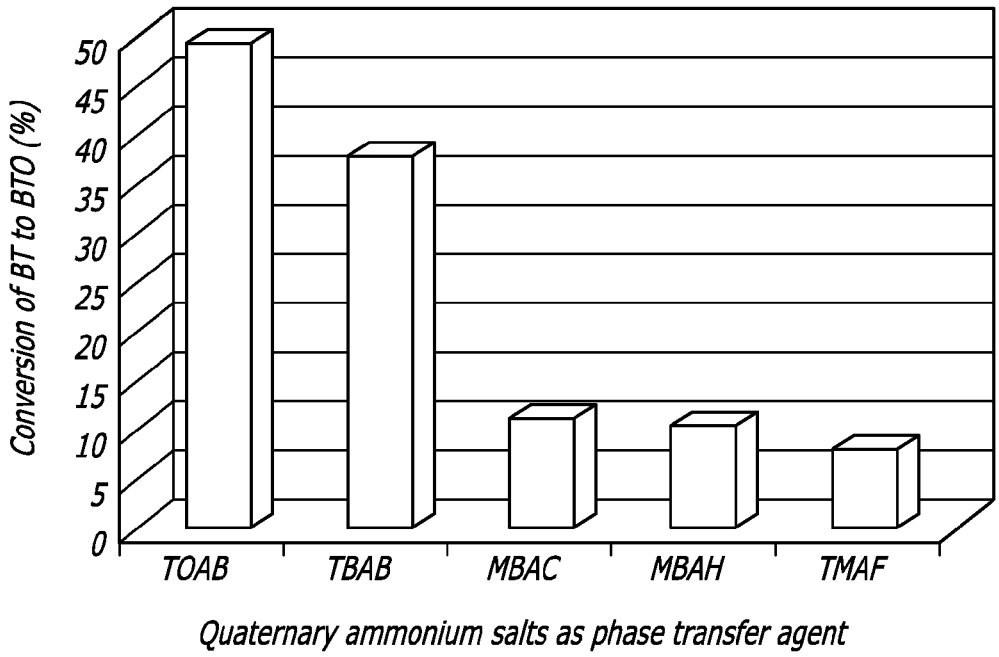
FIG. 1 Is a block graph indicating the effects of different alkyl chain length of quaternary ammonium salts in the oxidation of BT to BTO in accordance with one embodiment of the present invention.

The organic sulfur that is present as a naturally-occurring component of fossil (or petroleum-derived) fuels consists of a wide variety of compounds that are primarily hydrocarbons containing one or more sulfur atoms covalently bonded to the remainder of the molecular structure. There are many petroleum-derived compounds containing carbon, hydrogen and sulfur, and some of these compounds contain other heteroatoms as well. The hydrocarbon portions of these compounds may be aliphatic, aromatic, saturated, unsaturated, cyclic, fused cyclic, or otherwise, and the sulfur atoms may be included in the molecular structure as thiols, thioethers, sulfides, disulfides, and the like. Some of the most refractory of these compounds are sulfur-bearing heterocycles, both aromatic and non-aromatic, ranging from thiophene to fused structures such as substituted and unsubstituted benzothiophene and substituted and unsubstituted dibenzothiophene. Examples of these compounds are thiophene, benzothiophene, dibenzothiophene, 2-methylthiophene, 2-methylbenzothiophene, 4-methyldibenzothiophene, and the like.

Other examples are analogs in which the methyl groups are replaced by ethyl or other lower alkyl or alkoxy groups or substituted alkyl groups such as hydroxyl-substituted groups.

The use of fluorinated quaternary ammonium salts as phase transfer agents plays a significant role in the UAOD process due to sufficient transfer of oxidized metal anion into organic phase or O/W interface. Moreover, the structure of the quaternary ammonium salts (QAS) cation influences its ability to transfer ion from the aqueous to organic phase. Quaternary ammonium salts are compounds comprised of a positively charged nitrogen atom having four substituents, paired with a negatively charged counterion. The oxidation rate of BT to BTO increases with increasing carbon chain length of QAS cations. Under the same length of carbon chain, the oxidation rate of BT to BTO increases with decreasing the molecular size of QAS anions. Use of a quaternary ammonium fluoride as a phase transfer agent having at least one alkyl chain of 8 or more carbon atoms in length and no more than one substituent is an aryl group achieves superior results over QAS compounds without fluoride, F—, as the counterion or having alkyl substituents with less than 8 carbon atoms. Some preferred compounds are quaternary ammonium fluorides in which all four substituents are alkyl chains of 8 or more carbon atoms in length. One especially preferred quaternary ammonium fluoride is tetraoctylammonium fluoride (TOAF).

Another advantage to using a fluorine anion as the counter ion in the quaternary ammonium salt is the prevention of a few side effects from using ultrasound, including foaming and excessive decomposition of hydrogen peroxide in the reaction.

The term "hydroperoxide" is used herein to denote a compound of the molecular structure in which R represents either a hydrogen atom or an organic or inorganic group. Examples of hydroperoxides in which R is an organic group are water-soluble hydroperoxides such as methyl hydroperoxide, ethyl hydroperoxide, isopropyl hydroperoxide, n-butyl hydroperoxide, sec-butyl hydroperoxide, tert-butyl hydroperoxide, 2-methoxy-2-propyl hydroperoxide, tert-amyl hydroperoxide, and cyclohexyl hydroperoxide. Examples of hydroperoxides in which R is an inorganic group are peroxonitrous acid, peroxophosphoric acid, and peroxosulfuric acid. Preferred hydroperoxides are hydrogen peroxide (in which R is a hydrogen atom) and tertiary-alkyl peroxides, notably tert-butyl peroxide.

The aqueous fluid that is combined with the fossil fuel and the hydroperoxide may be water or any aqueous solution. The relative amounts of liquid fossil fuel and water may vary, and although they may affect the efficiency of the process or the ease of handling the fluids, the relative amounts are not critical to this invention. In most cases, however, best results will be achieved when the volume ratio of fossil fuel to aqueous fluid is from about 1:1 to about 3:1, and preferably from about 1:1.5 to about 1:2.5.

The amount of hydroperoxide relative to the fossil fuel and the aqueous fluid can also be varied, and although the conversion rate may vary somewhat with the proportion of hydroperoxide, the actual proportion is not critical to the invention, and any excess amounts will be eliminated by the ultrasound. When the hydroperoxide is H2O2, best results will generally be achieved in most systems with an H2O2 concentration within the range of from about 0.25% to about 30% by volume (as H2O2) of the combined aqueous and organic phases, and preferably from about 2% to about 4%. For hydroperoxides other than H2O2, the preferred relative volumes will be those of equivalent molar amounts.

Sonic energy in accordance with this invention is applied by the use of ultrasonics, which are soundlike waves whose frequency is above the range of normal human hearing, i.e., above 20 kHz (20,000 cycles per second). Ultrasonic energy with frequencies as high as 10 gigahertz (10,000,000,000 cycles per second) has been generated, but for the purposes of this invention, useful results will be achieved with frequencies within the range of from about 20 kHz to about 200 kHz, and preferably within the range of from about 20 kHz to about 50 kHz. Ultrasonic waves can be generated from mechanical, electrical, electromagnetic, or thermal energy sources. The intensity of the sonic energy may also vary widely. For the purposes of this invention, best results will generally be achieved with an intensity ranging from about 30 watts/cm2 to about 300 watts/cm2, or preferably from about 50 watts/cm2 to about 100 watts/cm2. The typical electromagnetic source is a magnetostrictive transducer which converts magnetic energy into ultrasonic energy by applying a strong alternating magnetic field to certain metals, alloys and ferrites. The typical electrical source is a piezoelectric transducer, which uses natural or synthetic single crystals (such as quartz) or ceramics (such a barium titanate or lead zirconate) and applies an alternating electrical voltage across opposite faces of the crystal or ceramic to cause an alternating expansion and contraction of crystal or ceramic at the impressed frequency. Ultrasound has wide applications in such areas as cleaning for the electronics, automotive, aircraft, and precision instruments industries, flow metering for closed systems such as coolants in nuclear power plants or for blood flow in the vascular system, materials testing, machining, soldering and welding, electronics, agriculture, oceanography, and medical imaging. The various methods of producing and applying ultrasonic energy, and commercial suppliers of ultrasound equipment, are well known among those skilled in the use of ultrasound.

The duration of the exposure of the reaction system to ultrasound in accordance with this invention is not critical to the practice or to the success of the invention, and the optimal amount will vary according to the type of fuel being treated. An advantage of the invention however is that effective and useful results can be achieved with sonic energy exposure of a relatively short period of time, notably less than twenty minutes and in many cases less than ten minutes. The sonic energy can be applied to the reaction system in a batchwise manner or in a continuous manner in which case the exposure time is the residence time in a flow-through ultrasound chamber.

While not intending to be bound by any particular theory, it has been reported that the application of ultrasound to a liquid system produces cavitation in the liquid, i.e., the continuous formation and collapse of microscopic vacuum bubbles with extremely high localized temperatures and pressures. For example, it is believed that ultrasonic waves at a frequency of 45 kHz produce 90,000 formation-implosion sequences per second and localized temperatures on the order of 5,000° C. and pressures on the order of 4,500 psi. This causes extreme turbulence and intense mixing.

In further embodiments of the invention, a metallic catalyst is included in the reaction system to regulate the activity of the hydroxyl radical produced by the hydroperoxide. Examples of such catalysts are Fenton catalysts (ferrous salts) and metal ion catalysts in general such as iron (II), iron (III), copper (I), copper (II), chromium (III), chromium (VI), molybdenum, tungsten, and vanadium ions. Of these, iron (II), iron (III), copper (II), and tungsten catalysts are preferred. For some systems, such as crude oil, Fenton-type catalysts are preferred, while for others, such as diesel and other systems where dibenzylthiophene is a prominent component, tungstates are preferred. Tungstates include tungstic acid, substituted tungstic acids such as phosphotungstic acid, and metal tungstates. The metallic catalyst when present will be used in a catalytically effective amount, which means any amount that will enhance the progress of the reaction toward the desired goal, which is the oxidation of the sulfides to sulfones. In most cases, the catalytically effective amount will range from about 1 mM to about 300 mM, and preferably from about 10 mM to about 100 mM.

The ultasound-assisted oxidation reaction generates heat and does not require the addition of heat from an external source. To maintain control over the reaction, it is preferable to draw heat from the reaction medium by using a coolant or cooling apparatus or mechanism. When cooling is achieved by immersing the ultrasound chamber in a coolant bath or circulating coolant, the coolant may be at a temperature of about 50° C. or less, preferably about 20° C. or less, and more preferably within the range of from about −5° C. to about 20° C. Suitable cooling methods or devices will be readily apparent to those skilled in the art.

Once the ultrasound is terminated, the product mixture will contain aqueous and organic phases, and the organic phase will contain the bulk of the sulfones produced by the oxidation reaction. The product mixture can be phase-separated prior to sulfone removal, or sulfone removal can be performed on the multiphase mixture without phase separation. Phase separation if desired can be accomplished by conventional means, preceded if necessary by breaking the emulsion caused by the ultrasound. The breaking of the emulsion is also performed by conventional means. The various possibilities for methods of performing these procedures will be readily apparent to anyone skilled in the art of handling emulsions, and particularly oil-in-water emulsions.

With their increased polarity relative to the sulfides originally present in the fossil fuels, the sulfones produced by this invention are readily removable from either the aqueous phase, the organic phase, or both, by conventional methods of extracting polar species. The sulfones can be extracted by solid-liquid extraction using absorbents such as silica gel, activated alumina, polymeric resins, and zeolites. Alternatively, the sulfones can be extracted by liquid-liquid extraction using polar solvents such as dimethyl formamide, N-methylpyrrolidone, or acetonitrile. Other extraction media, both solid and liquid, will be readily apparent to those skilled in the art of extracting polar species.

The term "liquid fossil fuels" is used herein to denote any carbonaceous liquid that is derived from petroleum, coal, or any other naturally occurring material and that is used for energy generation for any kind of use, including industrial uses, commercial uses, governmental uses, and consumer uses. Included among these fuels are automotive fuels such as gasoline, diesel fuel, jet fuel, and rocket fuel, as well as petroleum residuum-based fuel oils including bunker fuels and residual fuels. Bunker fuels are heavy residual oils used as fuel by ships and industry and in large-scale heating installations. No. 6 fuel oil, which is also known as "Bunker C" fuel oil, is used in oil-fired power plants as the major fuel and is also used as a main propulsion fuel in deep draft vessels in the shipping industry. No. 4 fuel oil and No. 5 fuel oil are used to heat large buildings such as schools, apartment buildings, and office buildings, and large stationary marine engines. The heaviest fuel oil is the vacuum residuum from the fractional distillation, commonly referred to as "vacuum resid," with a boiling point of 565° C. and above, which is used as asphalt and coker feed. The present invention is useful in reducing the sulfur content of any of these fuels and fuel oils.

One method for conducting UAOD utilizes a continuous flow system which can be operated at steady state with reactants continuously coming into the reaction vessel and the product continuously being removed.

This portable unit of the continuous flow system consists of a sonoreactor, an a radio transmitter, a function generator, a pretreatment tank and a pipeline system. The unit operates at ambient temperature and pressure for a given time. For the best quality or quantity purpose and performance, multiple sonoreactors can be scaled up to connect in series or in parallel, respectively.

Figure 11:
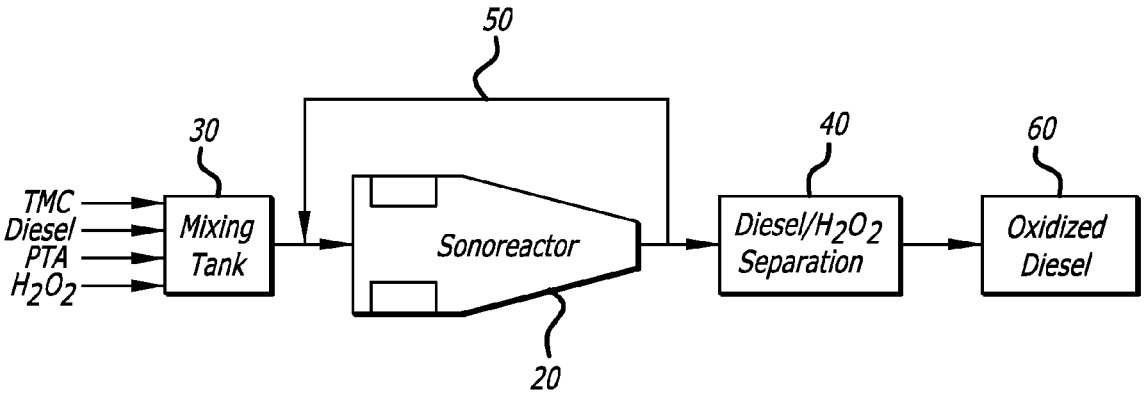
FIG. 11 is a schematic diagram of a portable continuous desulfurization process in accordance with another embodiment of the present disclosure.

In one embodiment of the present disclosure, the portable continuous desulfurization device comprises a pretreatment tank; a mixing tank connected to said pretreatment tank; a sonoreactor connected to the mixing tank; a radio transmitter connected to the sonoreactor; a function generator connected to the radio transmitter; and a product separating portion connected to the sonoreactor on an end opposite to the portion of the sonoreactor connected to the mixing tank. FIG. 11 shows a flow chart of the process in which the hydroperoxide (H2O2), the phase transfer catalyst, diesel fuel and a tungstate metal catalyst are added to the mixing tank 30. The diesel may be pretreated in a pretreatment tank (not shown) before mixing. The reaction mixture is then passed to the sonoreactor 20, which circulates the reaction mixture through a recirculation loop 50 for a period of time. During circulation, the radio transmitter (not shown) and function generator (not shown) generate and transmit radio frequencies to sonicate the reaction mixture in order to assist in the oxidation of the sulfur compounds present in the reaction mixture. After the reaction, the reaction mixture is passed to the diesel/H2O2 separation container 40 wherein the aqueous phase is separated from the organic phase, which results in low sulfur diesel fuel 60.

Figure 10:
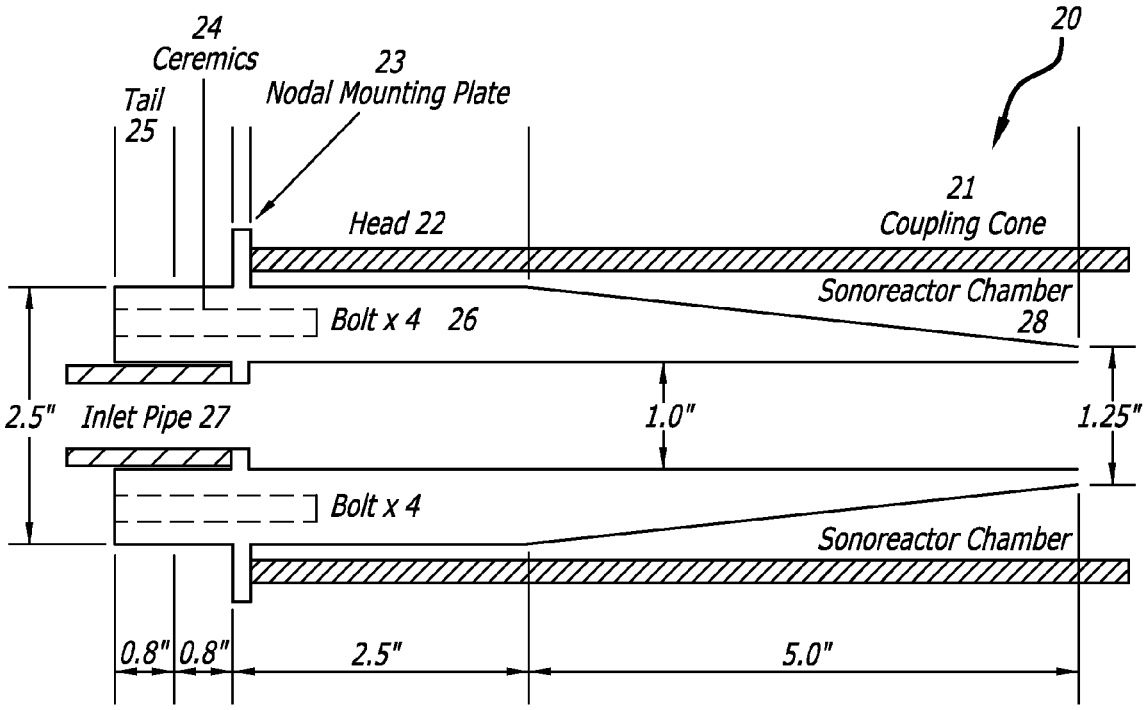
FIG. 10 is a cross-sectional view of a sonoreactor in accordance with one embodiment of the present disclosure.

FIG. 10 is a diagram of the sonoreactor 20 which comprises a coupling cone 21 having a tapered end; a cylindrical head portion 22 attached to the coupling cone 21 having a nodal mounting plate 23 protruding radially outward from the head portion 22; a tail portion 25 attached to the head portion 22 on a side opposite to the coupling cone 21; and a plurality of ceramic piezoelectric transducers 24 affixed to the tail portion. In this embodiment, the ceramics are affixed via a plurality of bolts 26. A reaction mixture is fed into the sonoreactor 20 via the inlet pipe 27 and flows through the sonoreactor 20 through the tapered end of the coupling cone 21.

This portable continuous desulfurization unit has significantly demonstrated that large amounts of diesel fuels can be treated in a short sonication time to reach high desulfurization efficiency with low capital investment and maintenance cost. Moreover, this sonoreactor may be operated under ambient temperature (25° C.±2° C.) can ensure the safety considerations. This technology has successfully demonstrated the high sulfur reduction of MGO (92%) at a treatment rate of 12.5 lb/hour in pilot scale. For quantity purpose and performance, two sonoreactors can be connected in parallel to reach high sulfur reduction under treatment rate of 25 lb/hour, or the equivalent of approximately 2 barrels per day.

Figure 9:
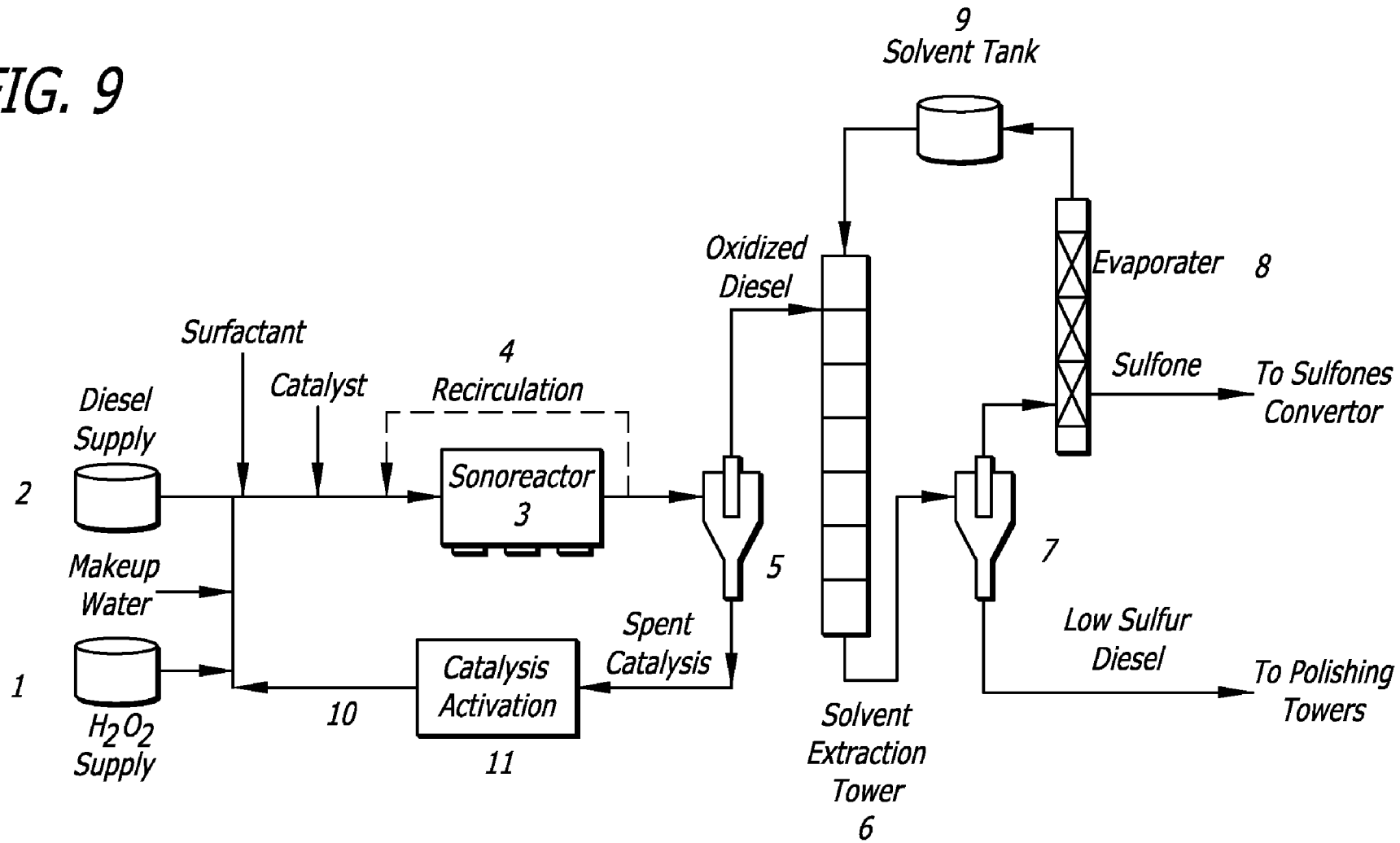
FIG. 9 is a schematic diagram of a typical continuous desulfurization process using ultrasound.

A diagram of a typical continuous flow system is shown in FIG. 9. H2O2 supply tank 1 and diesel supply tank 4 supply diesel and H2O2 to the circulation pipe 10. Surfactant and catalyst are added to form the reaction mixture. The reaction mixture then passes to the sonoreactor wherein the mixture is sonicated. The sonoreactor 3 has a chamber connected to the recirculation loop 4 through which the reaction mixture is passed for a period of time. The pretreatment micellar tank (not shown) may be used to change the orientation of the sulfur-bearing molecules. In addition, two hopper-type cyclones 5, 7 are shown, which include a first cyclone 5 used for the de-emulsification or separation of the oil phase from the aqueous phase and a second cyclone 7 used to receive the oxidized diesel after solvent extraction. Between the two cyclones 5, 7, there is a solvent extraction tower 6 where the sulfone byproduct and low sulfur diesel are partitioned out, and delivered to the second cyclone 7. There is an evaporation tower 8 to distill the solvent used for extraction to retrieve the solvent for reuse, which is stored in the solvent tank 9. In this evaporator, the sulfone byproducts are obtained. Catalyst may be reactivated after the reaction via the catalyst activation vessel 11.

In one embodiment of the present disclosure, the sonoreactor (Blatek Tech) is a tubular reactor mounted with electromechanical transducers; it provides the direct sonication to the process stream. The sonoreactor may be combined in series or parallel or both series and parallel. If the quality of fuel is extremely high in certain types of sulfur compounds, more than one module of the sonoreactor is required and can be used in a series. On the other hand, if the quantity of fuel is high, sonoreactors can be used in parallel. This module design unit demonstrates the feasibility of large-scale operation even with a relatively small installation.

Transducers used in modern power ultrasonic systems are almost without exception based upon the pre-stressed piezoelectric design. The sonoreactor shown in FIG. 10 is designed with 9.1 inch length and 1 inch inlet diameter, and may be operated at a frequency of 20 kHz with various power intensities from 100 watts to 400 watts. In one embodiment of the present disclosure, four piezoelectric ceramics are bolted between a pair of metal end masses, that couple with a coupling cone (horn type taper) made with titanium alloys. In another embodiment of the present invention, the piezoelectric elements would be of a pre-polarized lead titanate composition that exhibits high activity coupled with both low loss and ageing characteristics. The piezoelectric transducers are mounted in a fixture or in a protective case by means of the nodal mounting plate.

The radio transmitter is a collection of stages. Each stage modifies the signal in some way to produce the desired output. In the first stage, an oscillator or exciter generates the desired operating frequency. The output from this section is then raised to the specified transmitter output value. This power increase may be by means of successively larger amplifying stages or in some cases, where the exciter output is sufficient, directly to the final power amplifier (PA) of the transmitter.

An RF signal transmitted by a radio transmitter must carry some information. For example, in broadcasting, the information transmitted takes the form of speech or music and is called modulation. With amplitude modulation (AM), the RF carrier is varied in strength (amplitude) at a rate depending on the frequency of the sound. Regardless of where modulation of the carrier takes place, it is essential that the amplifying stage produces a clean, linearly amplified signal.

One example of an RF amplifier that may be used to control the power output in the present disclosure is the Amplifier Research 700A. Its detailed specifications are shown as below:

Power Output into 50 ohms
Maximum: up to 700 watts
Linear: 250 watts @ less than 1 dB gain compression
Frequency: 10 kHz to 250 kHz useful range from 8 kHz to 450 kHz at reduced gain
Gain: 60 dB minimum
Input Attenuator: Continuously adjustable over greater than an 18 dB range
Input Impedance: 50 ohms nominal
Output Impedance (Switch Selectable) 12.5, 25, 50, 100, 150, 200, 400, 600, 1000 ohms nominal
Connectors: type BNC
Power Meter: Directional power meter and front panel selector switch allows separate measurement of the forward power leaving the amplifier and the power reflected by the load
Primary Power: 115 VAC, 50/60 Hz, 15 Amp A function generator is used to generate repetitive waveforms which can be injected into a device under test and analyzed as they progress through the device, confirming the proper operation of the device or pinpointing a fault in the device. Moreover, function generators can generate a triangle waveform as their basic output.

The triangle is generated by repeatedly charging and discharging a capacitor from a constant current source. This produces a linearly-ascending or descending voltage ramp. As the output voltage reaches upper and lower limits, the charging and discharging is reversed, producing the linear triangle wave. By varying the current and the size of the capacitor, different frequencies may be obtained.

Thus, according to the present disclosure, ultrasound assisted desulfurization (UAOD) has been successfully optimized by using longer alkyl substituted quaternary ammonium salts with fluorine as phase transfer agents and transition metal catalyst with the assistance of ultrasound and hydrogen peroxide. For various fuels containing different levels of sulfur concentration, the optimized UAOD process followed by solvent extraction can reach or exceed 95% sulfur reduction, or final sulfur concentration less than 15 ppm in a short contact time under ambient temperature and atmospheric pressure. The use of the fluorinated quaternary ammonium salts also prevents the formation of unwanted brominated side products. Moreover, improving phase transfer capabilities also permits the complete recovery and highly efficient reuse of transition metal catalyst, thus executing the same desulfurization efficiency with diluted hydrogen peroxide.

Furthermore, the use of a continuous process using the sonoreactor disclosed herein can be utilized in a portable manner thereby effecting a high conversion rate of sulfide to sulfone, at ambient temperatures.

EXAMPLES

In each of the examples below, non-dispersive X-ray fluorescence (NDXRF) was used to determine the total sulfur content in the model compounds system based on method ASTM D4294-83. A Sulfur-in-Oil Analyzer (SLF A-20, Horiba Inc., California) was employed to determine any sample with total sulfur content range from 0.002 to 5 wt. % of sulfur.

The sulfur compounds in the feed and product were analyzed by a Varian gas chromatograph (Varian 3400) equipped with a pulsed flame photometric detector (PFPD) and an ion trap mass spectrometer (Saturn 2000, MS). A fused-silica capillary column DB-5 ms (30 m×0.25 mm I.D.) with 0.25 □m film thickness (J & W Scientific, Folsom, Calif. USA) was used. The column temperature program was first retained at 100° C. for 3 minutes, and was heated at the increasing rate of 6° C./min to 275° C. and kept at 275° C. for 10 minutes. Benzothiophene (BT), Benzothiophene Sulfone (BTO) and their families were identified and quantified with the standard samples. The other major peaks shown in GC-PFPD were identified using selected ion monitoring or comparing molecular ions in GC/MS.

The selective ion monitoring (SIM) technique in GC/MS analysis was employed to trace the change of organic sulfur compounds (OSCs). The changes of these compounds in UAOD process were monitored at molecular level by using SIM technique in Varian, Saturn GC/MS workstation.

The reduced subsequent peroxo species were analyzed by Inductively-Coupled Plasma (ICP) spectrophotometer (Perkin Elmer Plasma 40) for spent tungsten concentration.

Model compounds and chemicals, including Benzothiophene (BT), benzothiophene sulfone (BTO), 2-methylbenzothiophene (2MBT), dibenzothiophene (DBT), dibenzothiophene sulfone (DBTO), 4-methyldibenzothiophene (4MDBT), 4,6-Dimethyldibenzothiophene (46DMDBT), methyltributylammonium hydroxide (MBAH), tetraoctylammonium bromide (TOAB), tetraoctadecylammonium bromide (TODAB) tetraoctylammonium fluoride (TOAF), tetrabutylammonium bromide (TBAB), tetrametylammonium fluoride (TMAF), methyltributylammonium chloride (MTAC), phosphotungstic acid hydrate (H3PW12O40.20H2O, HPW), sodium phosphotungstic hydrate (Na3PW12O40.14H2O, NaPW), phosphomolybdic acid hydrate (H3PMo12O40.15H2O, HPMO), sodium phosphomolybdic hydrate (Na3PMo12O40.20H2O, NaPMo), Tween 80, and 1-octanesulfonic acid, were obtained from Aldrich Chemical, Milwaukee, Wis.

UAOD reaction conditions: Model sulfur compounds were dissolved into toluene to make a stock solution with the given sulfur content. An appropriate volume of the stock solution containing the phase transfer agent and an equal volume of hydrogen peroxide (30 vol % solution) containing transition catalyst metal were added into the glass reactor. The mixture was irradiated by ultrasound at a frequency of 20 kHz. During the period of ultrasonication, the mixture was emulsified and the temperature in the reactor was controlled using a 5-L thermal water bath. Upon cooling and centrifuging, the emulsion was broken and the sulfone of OSC was formed in the upper layer.

The following examples are offered for purposes of illustration and are not intended to limit the scope of the invention.

Example 1

In this example, model compounds were reacted under UAOD reaction conditions. Table 1 shows the oxidation of BT to BTO, which proceeds at very low or high reaction rate in presence of surface-active agents using quaternary ammonium salts (QAS) as cationic surfactants. The data indicates that an effective oxidant in the reaction system is in the form of peroxo metal anion and cationic surfactants; the QAS especially can function as a phase transfer agent and deliver the anion into organic phase or interfacial region, thus facilitating the oxidation of organic sulfur compounds.

TABLE 1

EFFECT OF DIFFERENT TYPES OF SURFACTANTS ON UAOD PROCESS

| Type | Surfactant | Desulfurization |
|---|---|---|
| Cationic | Tetraoctylammonium Bromide (TOAB) | + |
| | Tetrabutylammonium Bromide (TBAB) | + |
| | Methyltributylammonium Chloride (MBAC) | + |
| | Methyltributylammonium Hydroxide (MBAH) | + |
| | Tetramethylammonium Fluoride (TMAF) | + |
| Anionic | 1-Octanesulfonic Acid, Sodium Salt | – |
| Nonionic | Tween 80 | – |
| Control | No Surfactant | – |

Aside:
+ indicates that there is reaction occurring under reaction conditions.
– indicates that there is no reaction occurring under reaction conditions.

Furthermore, FIG. 1 illustrates that the oxidation rate of BT to BTO increased with increasing the carbon chain length of QAS cations. The catalytic activities in this example follows the order: (C8H17)4N+Br—(TOAB)>(C4H9)4N+Br—(TBAB)>(C4H9)3MeN+Cl—(MBAC)>(C4H9)3MeN+OH—(MBAH)>(CH3)4N+F—(TMAF).

Example 2

Figure 2:
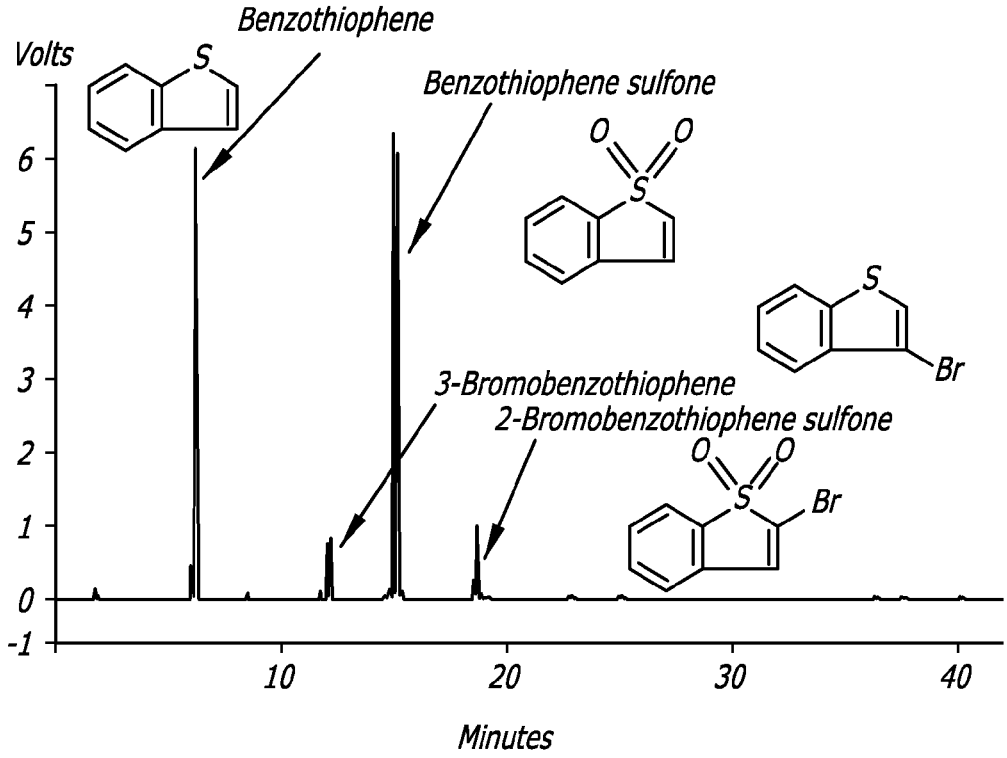
FIG. 2 is a GC-PFPD chromatogram of BT after a UAOD process using TAOB as the phase transfer agent.

This example illustrates the problems associated with the use of brominated QAS compounds as PTCs. Sample compounds were reacted under UAOD conditions. FIG. 2 shows that there were three sulfur products left in the desulfurized BT solution after using TAOB as PTA under UAOD conditions. Based on the retention time, these three sulfur compounds were categorized as BTO, 3-bromobenzothiophene and 2-bromobenzothiphene sulfone. This example illustrates how bromination is caused by the bromide anion of the QAS used as PTA.

Example 3

These examples illustrate the effectiveness of one UAOD process of the present disclosure and to determine the relative reactivity of various phase transfer agents and the superiority of TAOF as a PTA.

Figure 3:
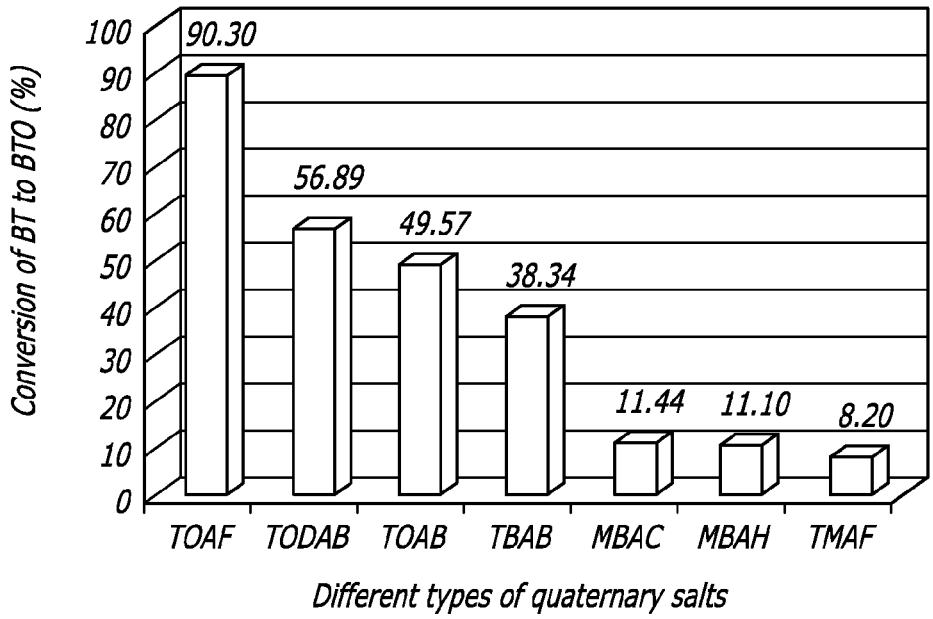
FIG. 3 is a block graph showing the comparison of conversion efficiencies of TOAF vs. various quaternary ammonium salts in accordance with another embodiment of the present invention.

The data in FIG. 3 illustrates the comparison of reaction yields of different quaternary ammonium salts used in this example to convert the BT to BTO. In this example, compounds were sonicated for 10 minutes. TOAF exhibited the highest yield. Again, the data also illustrate how increasing the alkyl chain length of the substituents in addition to using a fluoride anion in the PTC has a positive effect on the yield.

Figure 4:
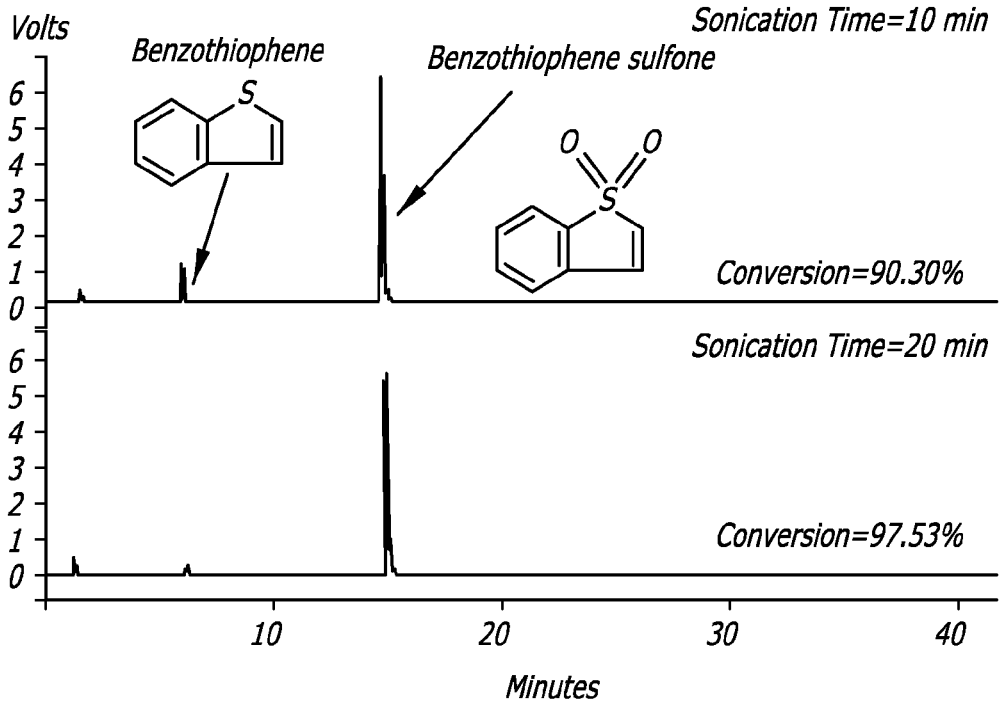
FIG. 4 are GC-PFPD chromatograms of BT using TOAF as phase transfer agent at two different sonication times in accordance with another embodiment of the present disclosure.

FIG. 4 illustrates how the BT to BTO conversion by use with TOAF as the PTA is further improved to 97.53% upon 20 minute reaction time. As is shown, the spectra are free of any brominated by-products.

Figure 5:
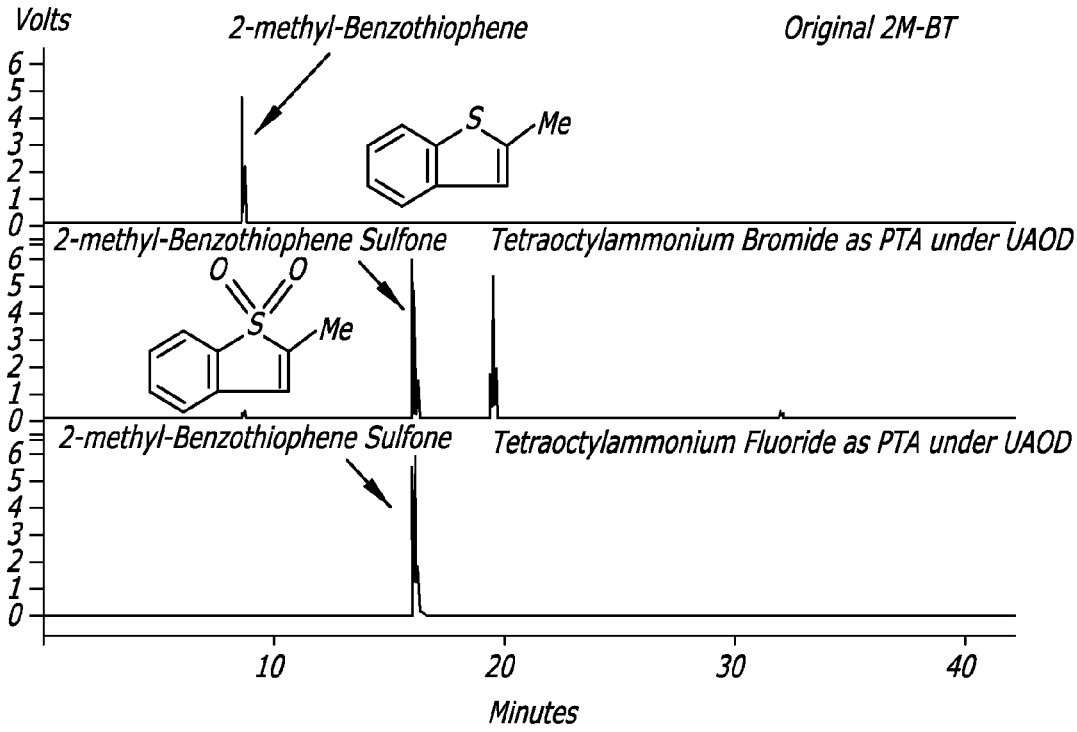
FIG. 5 are GC-PFPD chromatograms showing the comparison of oxidation products of 2-methyl-benzothiophene using the UAOD process with TOAB and TOAF as the phase transfer agents in accordance with another embodiment of the present disclosure.

FIG. 5 indicates the results of 2M-BT by using the TAOF as PTA. The brominated compounds are not formed when TOAF is used as the PTA, whereas with TAOB as PTA, a brominated by-product resulted.

Figure 6:
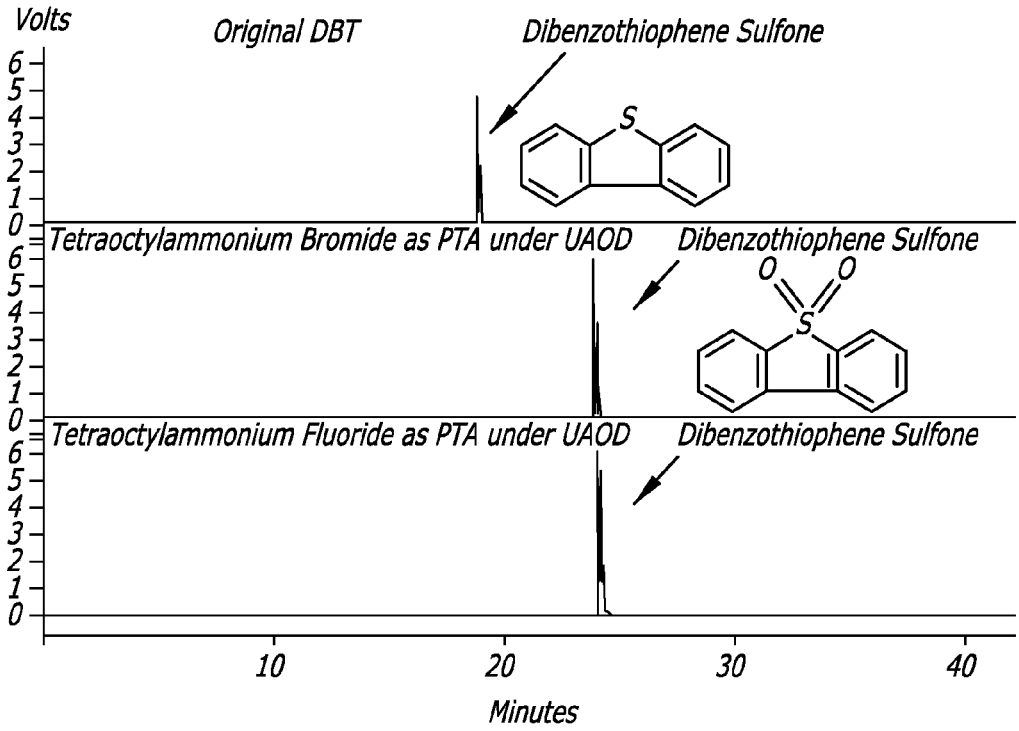
FIG. 6 are GC-PFPD chromatograms showing the comparison of oxidation products of dibenzothiophene using the UAOD process with TOAB and TOAF as the phase transfer agents in accordance with another embodiment of the present disclosure.

FIG. 6 indicates that using the same conditions for DBT as those for BT and 2M-BT, the results indicate that using TOAF or TOAB as the quaternary ammonium salt has similar results.

Figure 7:
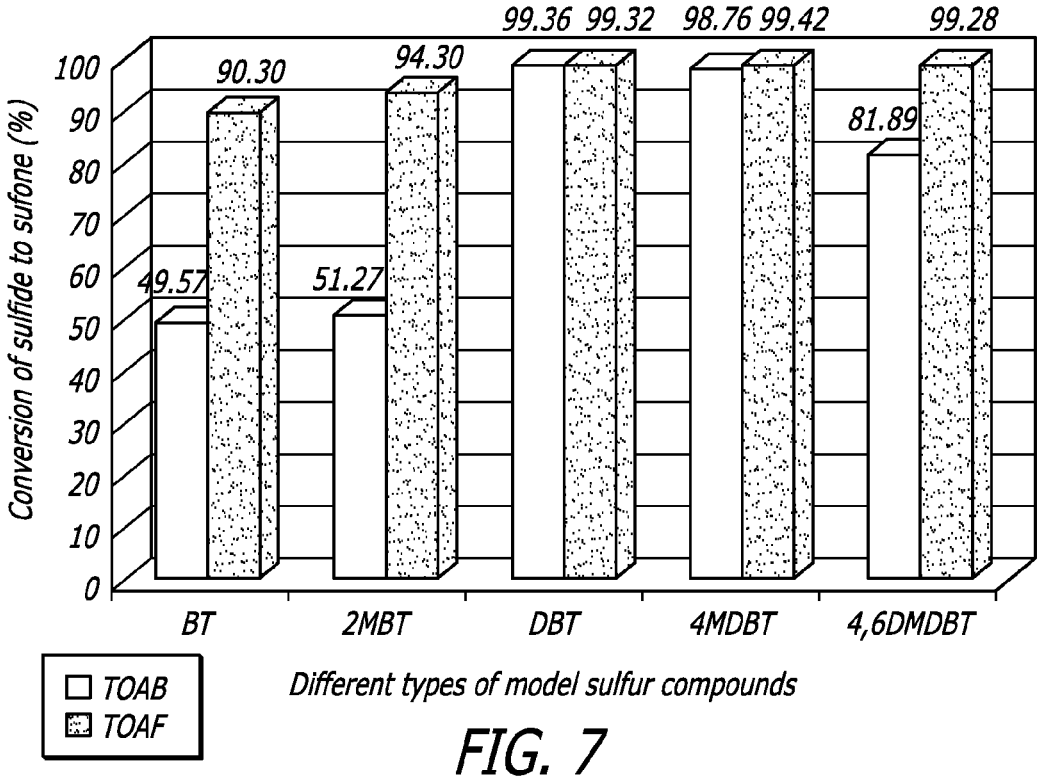
FIG. 7 is a block graph showing the comparison of oxidation yields of model sulfur compounds using TOAB and TOAF as the phase transfer agent in accordance with another embodiment of the present disclosure.

FIG. 7 shows the comparison of different model sulfur compounds by using TOAB and TOAF as PTA. TOAF exhibited better oxidation efficiency over a broad range of model sulfur compounds than TOAB. This example further illustrates that use of a fluorine anion has better efficiency to transfer metal anion into organic phase than a bromine anion of the same carbon chain length of QASs and thus permits a faster oxidation reaction (F—>Br—). Furthermore, the data indicates that the oxidation rate of sulfur organic compounds to their sulfones increased with increasing carbon chain length of QAS cations. Using the same length of carbon chain, the oxidation rate of BT to BTO increased with decreasing molecular size of QAS anions.

Example 4

This example illustrates the use of TAOF using the UAOD process on diesel fuels of varying sulfur content. Three marine diesel fuels, a jet fuel, and transportation diesel fuels containing various levels of sulfur content were used with catalytic oxidation and sonication followed by solvent extraction. High removals of sulfur-bearing compounds were achieved in a short contact time under low temperature and atmospheric pressure. The results of the oxidative desulfurization of diesels fuels by UAOD process are summarized in Table 2. The example also indicates that various fossil fuel diesel with different composition, distribution of OSCs, and total sulfur content from marine diesel fuels can lead to similarly low sulfur diesels (LSD) with respect to the remaining sulfur species after UAOD process. Therefore, for diesel fuels containing various levels of sulfur content and different composition and distribution of organic sulfur compounds, through the use of catalytic oxidation and sonication, sulfur removal efficiency can reach or exceed 95% in a short contact time, or final sulfur concentration can be less then 15 ppm at ambient temperature and pressure. This process can also be a simple approach to combine with conventional HDS process to obtain the ultra-law sulfur diesel.

TABLE 2

DESULFURIZATION EFFICIENCY OF UAOD PROCESS ON DIESEL FUELS

| Diesel Fuels | Sonication time (min) | Sulfur Content (ppm) Original | After Oxidation | After Extraction | Sulfur Removal (%) |
|---|---|---|---|---|---|
| F76 | 10 | 4,222 | 4,105 | 211.4 | 95.0 |
| MGO | 10 | 1,710 | 1,652 | 20.9 | 98.8 |
| JP5 | 10 | 113.7 | 104.8 | 14.2 | 87.5 |
| JP8 | 10 | 863 | 846 | 1.0 | 99.9 |
| Transportation | 10 | 259 | 216 | 10.0 | 96.1 |

Example 5

Figure 8:
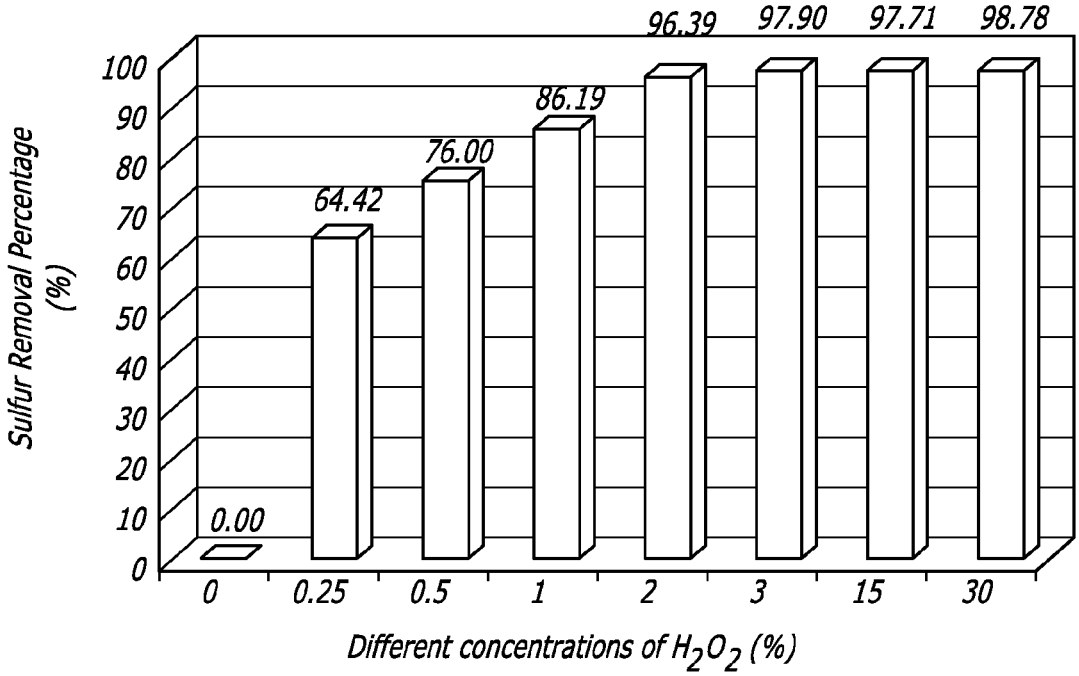
FIG. 8 is a block graph showing the desulfurization efficiency of different hydrogen peroxide concentrations on MGO under UAOD conditions in accordance with another embodiment of the present disclosure.

This Example shows the effect of concentration on the efficiency of the UAOD process in another embodiment of the present invention. FIG. 8 shows the desulfurization efficiencies of different hydrogen peroxide concentrations on MGO in batch scale. If there was no hydrogen peroxide applied to UAOD process, then no sulfur removal can be achieved. The results show that a concentration as low as 0.25% hydrogen peroxide can be used in the oxidation reaction, and achieve sulfur removal of 64.42%. Slightly increasing the concentrations of hydrogen peroxide allowed increasing efficiency of sulfur reduction. The concentration at 3% could dramatically increase the sulfur removal to 98.78% under the same operation conditions that use 30% hydrogen peroxide as oxidant. Moreover, 3% hydrogen peroxide could perform the same desulfurization efficiency in different diesel fuels, as shown in Table 3. It firmly demonstrated that using a broad range of dilute aqueous solutions results in favorable desulfurization efficiency. Thus, UAOD process could be operated under much safer environment using dilute hydrogen peroxide as the hydroperoxide.

TABLE 3

DIFFERENT $H_2O_2$ CONCENTRATIONS APPLIED TO DIFFERENT DIESELS IN UAOD PROCESS

| Hydrogen Peroxide | Sulfur Removal Percentage (%) | |
|---|---|---|
| Concentration (%) | MGO | F76 |
| 3 | 97.90 | 94.8 |
| 30 | 98.78 | 95.0 |

Example 6

In this example, the ultrasound-assisted oxidative desulfurization (UAOD) process oxidation of organic sulfur compounds was carried out in the presence of ultrasonication and excess H2O2 using phosphotungstic acid as transition metal catalyst and tetraoctylammonium fluoride as phase transfer agent. However, these catalysts are usually quite expensive. The commercial viability of UAOD processes that uses transition metal catalysts depends on the efficiency of catalyst recovery.

This study was conducted by using ICP to analyze the changed tungsten concentrations before and after UAOD process.

TABLE 4

TUNGSTEN RECOVERY AFTER UAOD PROCESS

| Original W Concentration (ppm) | W Concentration after UAOD Process (ppm) | Tungsten Recovery Percentage |
|---|---|---|
| 6128.0 | 6096.7 | 99.49% |

Table 4 shows that 99.49% of tungsten remained at aqueous phase. It indicated that the tungsten could be fully recovered after the oxidation reaction.

Example 7

This example shows that several experiments were conducted by using the spent aqueous phase mixed with original diesel to run the UAOD process. Two conditions, with and without PTA, were considered as the control parameters.

TABLE 5

SPENT CATALYST REUSED IN UAOD PROCESS

| Experiment | Original Sulfur Conc. (ppm) | Final Sulfur Conc. (ppm) | PTA | Total Sulfur Removal Percentage |
|---|---|---|---|---|
| New Catalyst | 1710 | 20.9 | TOAF | 98.78% |
| Spent Catalyst | 1710 | 31.7 | TOAF | 98.15% |
| Spent Catalyst | 1710 | 68.3 | None | 96.01% |

Table 5 shows that two control units with sulfur removal percentage was 98.15% (with PTA) and 96.01% (without PTA), respectively. Comparing to the first run of UAOD process with 98.78% sulfur removal percentage on MGO, the anionic peroxometal complex, {PO4[WO(O2)2]4}3—, still had high efficiency to permit the oxidation reaction.

In UAOD process, the transition metal catalyst plays an important role to accelerate the reaction and enhance the oxidation efficiency. However, the wasted catalyst may cause an increase in the capital cost and result in environment pollution. Complete catalyst recovery is one method to enhance the commercial viability of UAOD processes.

The foregoing is offered primarily for illustrative purposes. The present disclosure is not limited to the above described embodiments, and various variations and modifications may be possible without departing from the scope of the present invention.

The invention claimed is:

1. A portable continuous desulfurization device comprising:

a mixing tank;

a sonoreactor having an opening at a first end and an opening at a second end opposite the first end, wherein the opening at the first end is connected to said mixing tank;

a radio transmitter connected to said sonoreactor;

a function generator connected to said radio transmitter; and a product separating portion connected to the opening at the second end of the sonoreactor, wherein said sonoreactor comprises a coupling cone having a tapered end.

2. The portable continuous desulfurization device according to claim 1, further comprising:

a cylindrical head portion attached to said coupling cone having a nodal mounting plate protruding radially outward from said head portion;

a tail portion attached to the head portion on a side opposite to the coupling cone; and a plurality of piezoelectric transducers affixed to said tail portion.

3. The portable continuous desulfurization device according to claim 2, wherein said plurality of piezoelectric transducers are comprised of lead titanate.

4. The portable continuous desulfurization device according to claim 1, wherein said sonoreactor is connected to said mixing tank with a recirculation loop.

5. The portable continuous desulfurization device according to claim 1, further comprising a pretreatment tank;

wherein said pretreatment tank is connected to said mixing tank.

6. The portable continuous desulfurization device according to claim 2 comprising a plurality of said sonoreactors, said sonoreactors being connected in series.

7. The portable continuous desulfurization device according to claim 2 comprising a plurality of said sonoreactors, said sonoreactors being connected in parallel.

8. The portable continuous desulfurization device according to claim 2 comprising a plurality of said sonoreactors, said sonoreactors being connected first in parallel and then in series.

9. The portable continuous desulfurization device according to claim 2 comprising a plurality of said sonoreactors, said sonoreactors being connected first in series and then in parallel.

10. A portable continuous desulfurization device comprising:

a mixing tank;

a sonoreactor having an opening at a first end and an opening at a second end opposite the first end, wherein the opening at the first end is connected to said mixing tank; and a product separating portion connected to the opening at the second end of said sonoreactor, wherein said sonoreactor comprises a coupling cone having a tapered end.

11. The portable continuous desulfurization device according to claim 10 further comprising: a pretreatment tank;

wherein said pretreatment tank is connected to said mixing tank.

12. The portable continuous desulfurization device according to claim 10 further comprising: a plurality of said sonoreactors, said sonoreactors being connected in series.

13. The portable continuous desulfurization device according to claim 10 comprising: a plurality of said sonoreactors, said sonoreactors being connected in parallel.

14. The portable continuous desulfurization device according to claim 10 comprising: a plurality of said sonoreactors, said sonoreactors being connected first in parallel and then in series.

15. The portable continuous desulfurization device according to claim 10, further comprising:

a cylindrical head portion attached to said coupling cone having a nodal mounting plate protruding radially outward from said head portion;

a tail portion attached to the head portion on a side opposite to the coupling cone; and a plurality of piezoelectric transducers affixed to said tail portion.

16. A portable continuous desulfurization device comprising:

a plurality of sonoreactors, each sonoreactor having an opening at a first end and an opening at a second end opposite the first end, wherein:

the plurality of sonoreactors are connected in series, and each said sonoreactor comprises a coupling cone having a tapered end;

a cylindrical head portion attached to said coupling cone having a nodal mounting plate protruding radially outward from said head portion;

a tail portion attached to the head portion on a side opposite to the coupling cone; and a plurality of piezoelectric transducers affixed to said tail portion, wherein said device further comprises:

a mixing tank connected to the opening at the first end of one sonoreactor at a terminal end of the series of sonoreactors; and a product separating portion connected to the opening at the second end of a sonoreactor on an end of the series opposite to the sonoreactor connected to said mixing tank.

17. The portable continuous desulfurization device according to claim 16, further comprising another plurality of sonoreactors connected in parallel after the plurality of sonoreactors connected in series.

18. A portable continuous desulfurization device comprising: a plurality of sonoreactors connected in parallel, wherein:

each said sonoreactor comprises a coupling cone having a tapered end; and each sonoreactor has an opening at a first end and an opening at a second end opposite the first end, a cylindrical head portion attached to said coupling cone having a nodal mounting plate protruding radially outward from said head portion;

a tail portion attached to the head portion on a side opposite to the coupling cone; and a plurality of piezoelectric transducers affixed to said tail portion, wherein said device further comprises:

a mixing tank connected to the opening at the first end of the plurality of sonoreactors; and a product separating portion connected to the opening at the second end of the plurality of sonoreactors.

19. The portable continuous desulfurization device according to claim 18, further comprising another plurality of sonoreactors connected in series after the plurality of sonoreactors connected in parallel.

* * * * *